US009300071B1

(12) United States Patent
Bianca et al.

(10) Patent No.: US 9,300,071 B1
(45) Date of Patent: Mar. 29, 2016

(54) SYSTEMS HAVING AN ACTUATOR FORCING A RESILIENT RETAINER THROUGH A COMPRESSOR TO SECURE ELECTRICAL CONTACTS IN AN ELECTRICAL COMPONENT

(71) Applicants: Giuseppe Bianca, Temecula, CA (US); Mohamed Abrahim Ali, Mission Viejo, CA (US)

(72) Inventors: Giuseppe Bianca, Temecula, CA (US); Mohamed Abrahim Ali, Mission Viejo, CA (US)

(73) Assignee: TYCO ELECTRONICS SERVICES GmbH, Schaffhausen (CH)

( * ) Notice: Subject to any disclaimer, the term of this patent is extended or adjusted under 35 U.S.C. 154(b) by 0 days.

(21) Appl. No.: 14/518,000

(22) Filed: Oct. 20, 2014

(51) Int. Cl.
*H01R 13/627* (2006.01)
*H01R 13/426* (2006.01)
*H01R 43/20* (2006.01)

(52) U.S. Cl.
CPC ..... *H01R 13/426* (2013.01); *H01R 13/6277* (2013.01); *H01R 43/20* (2013.01)

(58) Field of Classification Search
CPC ..... H01R 13/627; H01R 13/6277
USPC ..... 439/349–358
See application file for complete search history.

(56) References Cited

U.S. PATENT DOCUMENTS

| | | | | |
|---|---|---|---|---|
| 4,021,094 | A * | 5/1977 | Hild | H01R 4/34 439/733.1 |
| 4,437,673 | A * | 3/1984 | Miyamoto | F16J 15/3456 277/402 |
| 4,478,472 | A * | 10/1984 | Baar | H05K 7/1007 439/264 |
| 2013/0122732 | A1* | 5/2013 | Blakborn | H01R 13/6277 439/357 |
| 2013/0210261 | A1* | 8/2013 | Weber | H01R 43/26 439/358 |
| 2014/0308846 | A1* | 10/2014 | Bianca | H01R 13/424 439/595 |

* cited by examiner

*Primary Examiner* — Chandrika Prasad

(57) ABSTRACT

A system for securing one or more electrical contacts within an electrical component includes a main housing defining a contact-retaining chamber, a base fixed within the contact-retaining chamber, a resilient retainer supported on the base and positioned around at least a portion of the one or more electrical contacts, a compressor within the contact-retaining chamber, wherein the resilient retainer is positioned between the base and the compressor, and a moveable actuator configured to be moved into a retaining position in which a retaining force is exerted into the compressor. The retaining force is translated into the resilient retainer to securely retain the electrical contact(s) within the electrical component.

13 Claims, 6 Drawing Sheets

SYSTEMS HAVING AN ACTUATOR FORCING A RESILIENT RETAINER THROUGH A COMPRESSOR TO SECURE ELECTRICAL CONTACTS IN AN ELECTRICAL COMPONENT

BACKGROUND OF THE DISCLOSURE

Embodiments of the present disclosure generally relate to systems and methods for retaining electrical contacts within electrical components, such as high density electrical connector assemblies.

Various communication or computing systems use electrical connectors to transmit data signals between different components of the systems. An electrical connector may electrically and mechanically connect one electrical component, such as a circuit board, server, or the like to another electrical component.

As data processing demands continue to increase, electrical connectors have been developed with an increased number of electrical contacts. In many applications, a high density pattern of electrical contacts is desired. A high density pattern of electrical contacts is one in which a center-to-center spacing of neighboring electrical contacts creates a thin insulative material between the neighboring contacts.

However, high density contact applications may not provide sufficient space for known contact retention systems and methods to securely retain the electrical contacts. For example, known molded contact retention systems and known retention clip retainer systems are typically too bulky for various high density applications.

A need exists for a practical system and method of efficiently retaining electrical contacts within a high density array or pattern.

BRIEF DESCRIPTION OF THE DISCLOSURE

Certain embodiments of the present disclosure provide a system for securing one or more electrical contacts within an electrical component. The system may include a main housing defining a contact-retaining chamber, a base fixed within the contact-retaining chamber, a resilient retainer supported on the base and positioned around at least a portion of the electrical contact(s), a compressor within the contact-retaining chamber, wherein the resilient retainer is positioned between the base and the compressor, and a moveable actuator configured to be moved into a retaining position in which a retaining force is exerted into the compressor. The retaining force is translated into the resilient retainer to securely retain the electrical contact(s) within the electrical component. In at least one embodiment, the resilient retainer securely retains the electrical contact(s) by deforming and flowing into or otherwise filling one or more interstices of the electrical contact(s) in response to the moveable actuator moving into the retaining position. The resilient retainer may be formed of rubber, for example.

The system may include an actuator track that moveably retains the moveable actuator. The moveable actuator may be configured to slide over the compressor into the retaining position. In another embodiment, the moveable actuator may be or include a plunger that is configured to be pushed into the compressor. In still another embodiment, the moveable actuator is configured to be pulled into the compressor.

In at least one embodiment, the actuator is configured to be rotated into the retaining position. For example, the actuator may include a rotatably cap that is threadably secured to the main housing.

Each of the electrical contacts may include a barrel secured to one or more leads. The electrical component may be or include an electrical connector assembly.

Certain embodiments of the present disclosure provide a method for securing one or more electrical contacts within an electrical component. The method may include defining a contact-retaining chamber within a main housing, fixing a base to or within the contact-retaining chamber, supporting a resilient retainer on the base, positioning the resilient retainer around at least a portion of the electrical contact(s), positioning a compressor in relation to the resilient retainer, wherein the positioning the compressor includes positioning the resilient retainer between the base and the compressor, and engaging an actuator into a retaining position with respect to the compressor. The engaging operation may include exerting a retaining force into the compressor, and translating the retaining force into the resilient retainer to securely retain the one or more electrical contacts within the electrical component. The method may also include disengaging the actuator from the retaining position. The disengaging operation releases the one or more resilient retainer from securely retaining the one or more electrical contacts within the electrical component.

DETAILED DESCRIPTION OF THE DISCLOSURE

Embodiments of the present disclosure provide systems and methods for retaining electrical contacts within an electrical component, such as an electrical connector assembly, a circuit board, a server, and/or the like. A contact-retaining system may include a resilient retainer that is configured to be urged into or around a portion of an electrical contact, such as an outer longitudinal portion or shaft of the electrical contact. For example, an actuator may urge a compressor, such as a rigid layer of hard plastic, into the resilient retainer. As the resilient retainer is urged toward and/or into the electrical contact, the resilient retainer is blocked by a base that prevents the resilient retainer from passing further therein. The resilient retainer is trapped between the compressor and the base. Because the resilient retainer is confined within a fixed volume of space between the compressor and the base, the force exerted by the actuator into the compressor forces the resilient retainer to deform and flow into or otherwise fill interstices or other such gaps, spaces, or the like of at least portions of the electrical contact, thereby securely retaining the electrical contact in place. For example, in at least one embodiment, the interstices may be features within an electrical contact, such as crimp detents in a wire barrel that are configured to secure a wire to a contact.

Figure 1:
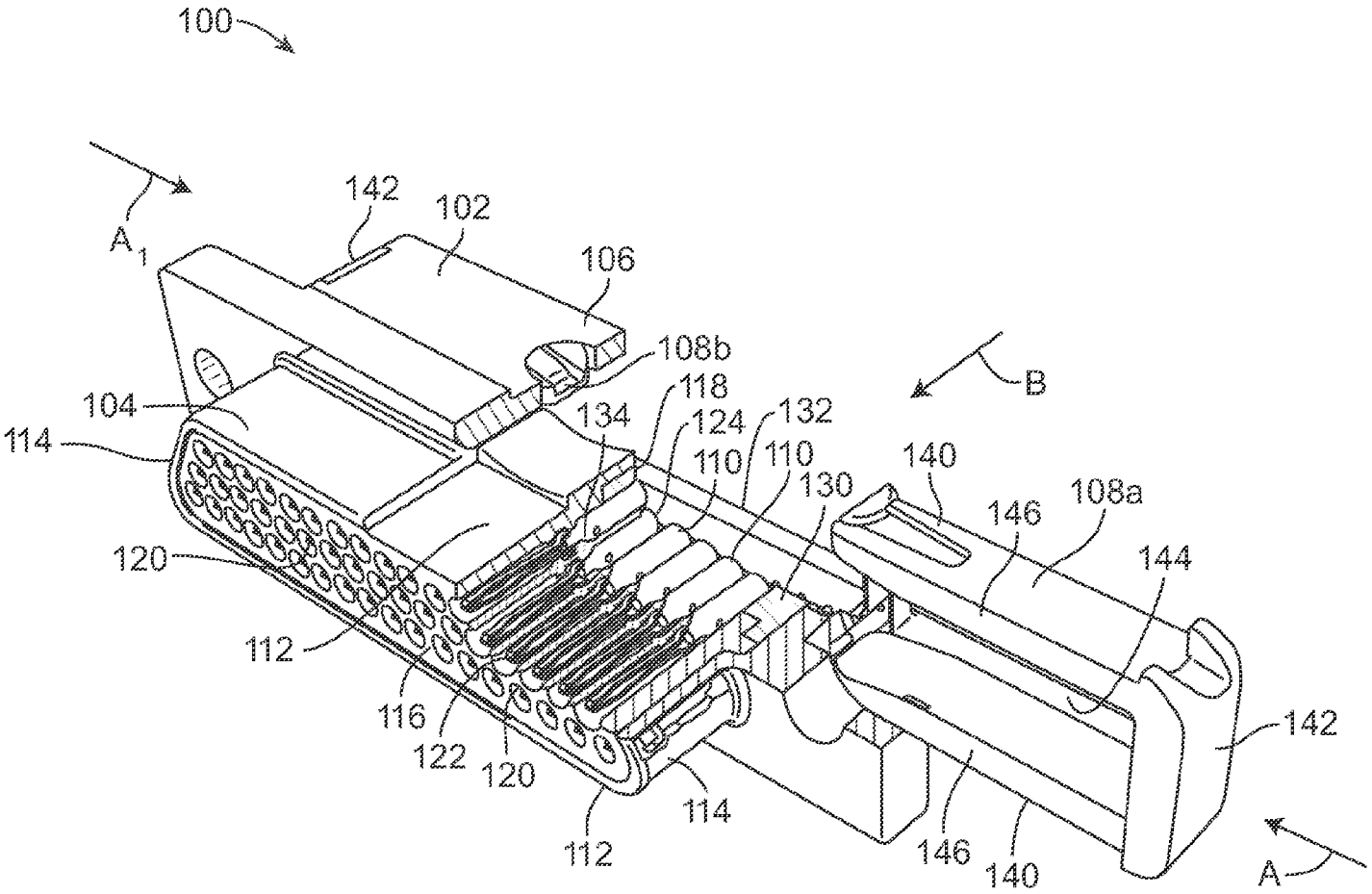
FIG. 1 illustrates a perspective front view of an electrical connector assembly, according to an embodiment of the present disclosure.

FIG. 1 illustrates a perspective front view of an electrical connector assembly 100, according to an embodiment of the present disclosure. The electrical connector assembly 100 includes a main housing or shell 102 that includes a contact-retaining chamber 104. The main housing 102 may include one or more actuator tracks 106 that are configured to moveably retain one or more actuators 108*a* and 108*b*. The contact-retaining chamber 104 houses a plurality of electrical contacts 110.

As shown in FIG. 1, a portion of the main housing 102 is removed to show internal components. For example, the contact-retaining chamber 104 includes opposed lateral walls 112 integrally connected to opposed end walls 114, a face 116, and an opposite surface 118 from the face 116. The lateral walls 112, end walls 114, and face 116, for example, may be formed of a metal, for example aluminum, and may include an insulating layer. The face 116 includes contact openings 120 that provide passages to ends 122 of the electrical contacts 110. Opposite ends 124 of the electrical contacts 110 may be exposed through the rear surface 118.

A compressor 130 may be positioned within the contact-retaining chamber 104 around the ends 124 of the electrical contacts 110. The compressor 130 may be a layer, beam, strip, sheet, or the like of hard, rigid, non-resilient plastic or metal, for example. As shown, the compressor 130 may be exposed through the rear surface 118.

A deformable, resilient retainer 132 is positioned between the compressor 130 and a fixed, rigid base 134, which may be an integral base portion of the main housing 102. The retainer 132 may be formed of a resilient material, such as rubber or another elastomeric material that is configured to deform, flow, or otherwise move when a compressive force is exerted therein.

Each actuator 108*a* and 108*b* may include lateral beams 140 that integrally connect to a cross handle 142. The cross handle 142 may connect the lateral beams 140 together such that a space 144 is defined therebetween. Each lateral beam 140 may include a tapered protuberance 146, such as an ridge, rib, or the like extending along its length. As the actuators 108*a* and 108*b* are urged into a retaining position, the lateral beams 140 slide over portions of the compressor 130. During this movement, the protuberances 146 force the compressor 130 toward the retainer 132, which moves toward the base 134. The base 134 forms a barrier past which the compressor 130 is unable to pass. In short, the retainer 132 is confined or trapped within a space between the compressor 130 and the base 134. Accordingly, as the actuator 108 is urged over the compressor 130 is urged into the retainer 132 between the compressor 130 and the base 134. During the compressive sandwiching, the retainer 132 deforms and flows into or otherwise fills interstices of at least portions of the electrical contacts 110, thereby securely retaining the electrical contacts 110 within the contact-retaining chamber 104. In short, as the actuator 108*a* or 108*b* is urged into a retaining position over the compressor 130, the retainer 132 is compressively sandwiched between the hard and rigid compressor 130 and the base 134, which forces portions of the retainer 132 to move into interstices of at least portions of the electrical contacts 110, thereby securely retaining the electrical contacts 110 in position.

The actuators 108*a* and 108*b* are configured to slide over the compressor 130 in the directions A and A', respectively, in order to exert a retaining force B into the compressor 130. The directions A and A' are orthogonal to the direction of the exerted retaining force B.

As shown in FIG. 1, the actuator 108*a* is in a disengaged position. The actuator 108*a* is not in contact with the compressor 130. In contrast, the actuator 108*b* (although portions of the actuator 108*a* are not shown in order to show the internal components of the electrical connector assembly 100) is shown in an engaged position over a portion of the compressor 130. In order to move the actuator 108*a* into an engaged position, the cross handle 142 of the actuator 108*a* is pushed in the direction of arrow A. Conversely, in order to move the actuator 108*b* into a disengaged position, the cross handle 142 of the actuator 108*b* is pulled in the direction of arrow A.

The electrical connector assembly 100 may include more or less actuators than shown. For example, instead of two opposed actuators, the electrical connector assembly 100 may include a single actuator that is configured to slide over the length of the compressor 130. Alternatively, the electrical connector assembly 100 may include various other actuators, such as plungers, that are configured to be directly urged into and away from the compressor 130.

While the electrical connector assembly 100 is shown, embodiments of the present disclosure may be used with various other electrical components. For example, embodiments of the present disclosure may be used with respect to electrical contacts in any type of electrical connector assembly, a circuit board, server, and/or the like. Further, embodiments of the present disclosure may be used with electrical connector assemblies having various shapes and sizes other than shown. For example, the electrical connector assembly 100 may house more or less electrical contacts than shown. In at least one embodiment, the electrical connector assembly 100 may include more or less rows or electrical contacts than shown. Additionally, the shape of the electrical connector assembly 100 may be other than rectangular, square, or linear. For example, the contact-retaining chamber 1045 may have an arcuate shape, such as circular, elliptical, or the like. In at least one embodiment, the electrical connector assembly 100 may have a circular shape, which may allow compression to be performed through a threaded backshell and/or threaded retainer.

Figure 2:
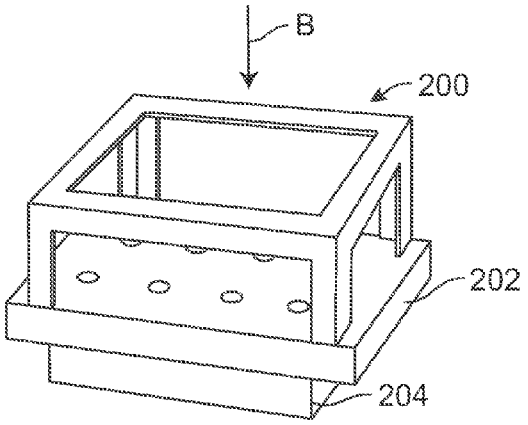
FIG. 2 illustrates a perspective front view of an actuator in relation to a compressor and a retainer, according to an embodiment of the present disclosure.

FIG. 2 illustrates a perspective front view of an actuator 200 in relation to a compressor 202 and a retainer 204, according to an embodiment of the present disclosure. As shown, the actuator 200 may be positioned directly over the compressor 202. For example, the actuator 200 may be aligned and coaxial with the compressor 202. In order to force the compressor into the retainer 204, the compressor 202 may be urged directly into the compressor 202 in the direction of arrow B, instead of sliding over a surface of the compressor 202.

The actuator 200 is pushed into the compressor 202 in the same direction B as the retaining force that is exerted into the compressor 202. As such, the direction of movement of the actuator 200 and the direction of force exerted into the compressor 202 are the same or otherwise parallel.

Figure 3:
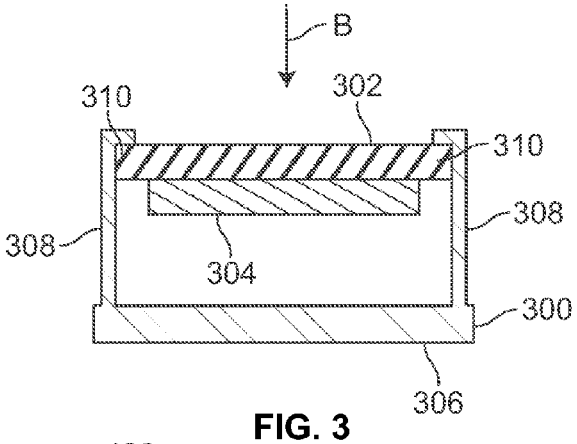
FIG. 3 illustrates a simplified lateral view of an actuator in relation to a compressor and a retainer, according to an embodiment of the present disclosure.

FIG. 3 illustrates a simplified lateral view of an actuator 300 in relation to a compressor 302 and a retainer 304, according to an embodiment of the present disclosure. In this embodiment, the compressor 302 may hook over portions of the compressor 302. For example, the compressor 302 may include a handle 306 connected to outer beams 308 that hook onto outer edges 310 of the compressor 302. In order to securely retain electrical contacts through deformation of the retainer 304, the handle 306 of the actuator 300 is pulled in the direction of arrow B.

The actuator 300 is pulled into the compressor 302 in the same direction B as the retaining force that is exerted into the compressor 302. As such, the direction of movement of the actuator 300 and the direction of the force exerted into the compressor 302 are the same or otherwise parallel.

FIGS. 1-3 show and describe examples of actuators. It is to be understood that various other types of actuators that urge a compressor into a retainer may be used.

Figure 4:
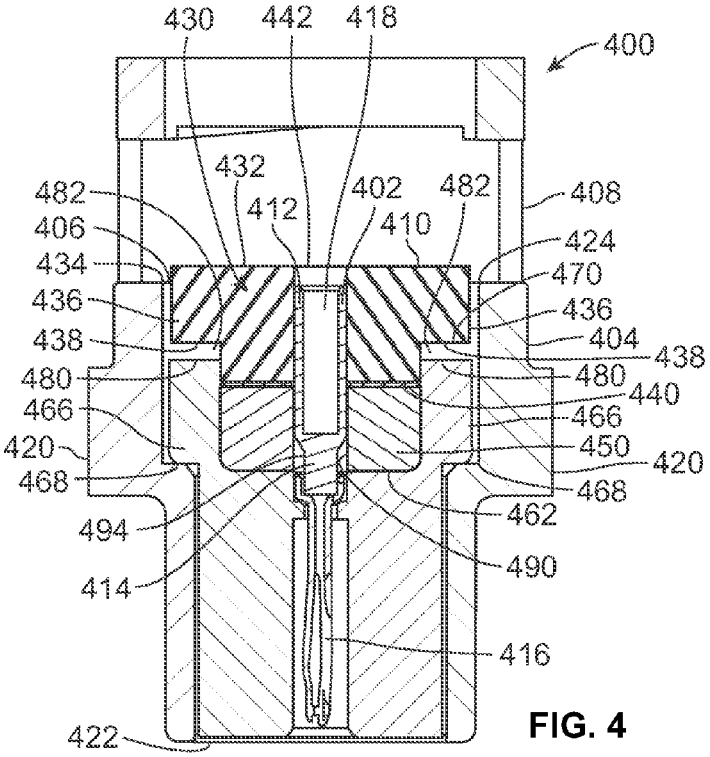
FIG. 4 illustrates an axial cross-sectional view of an electrical connector assembly having an unsecured electrical contact, according to an embodiment of the present disclosure.

FIG. 4 illustrates an axial cross-sectional view of an electrical connector assembly 400 having an unsecured electrical contact 402, according to an embodiment of the present disclosure. The electrical connector assembly 400 includes a main housing or shell 404 that defines an internal contact-retaining chamber 406. The main housing 404 may include one or more actuator tracks 408 that are configured to moveably retain one or more actuators. An actuator is not within the actuator track 408 at the position shown in FIG. 4. Instead, the actuator is in a disengaged position (in relation to a compressor 410). The contact-retaining chamber 406 houses the electrical contact 402. For the sake of clarity, only one electrical contact 402 is shown in FIG. 4. However, it is to be understood that various other electrical contacts 402 may be housed within the contact-retaining chamber 406.

The electrical contact 402 may include a barrel 412 integrally connected to a reduced diameter stud 414. One or more electrical leads 416 are secured to the stud 414, such as through soldering, bonding, or the like. The barrel 412 includes an open-ended internal chamber 418 that is configured to receive a reciprocal feature of another electrical contact (not shown). Various other types of electrical contacts other than shown may be used. For example, the electrical contact may be or include an eye-of-the-needle contact, a deflectable contact beam, a pin, socket, and/or the like.

The contact-retaining chamber 406 includes opposed lateral walls 420 integrally connected to opposed end walls (not shown in FIG. 4), a face 422, and an opposite surface 424 from the face 422. A compressor 430 may be positioned within the contact-retaining chamber 406. The compressor 430 may be formed of a rigid, non-deformable material, such as a hard plastic or metal. The compressor 430 includes an exposed surface 432 having a width that is generally as wide as the internal diameter of an opening 434 of the contact-retaining chamber 406. The exposed surface 432 connects to outer edges 436 that connect to an internal peripheral shoulder 438 that connects to a reduced width retainer-contacting beam 440. As shown, a contact channel 442 is formed through the compressor 430. The electrical contact 402 is positioned within the contact channel 442.

A deformable, resilient retainer 450 is positioned between the compressor 430 and a fixed, rigid base 460, which may be integrally formed with the main housing 404. As shown, the base 460 includes a pocket 462 into which the retainer 450 seats. The retainer 450 is confined or trapped within the pocket 462 between the compressor 430 and the base 460. The base 460 may be formed of a rigid, non-deformable material such as a hard plastic, metal, or the like. Outer ledges 466 of the base 460 are positioned around an outer edge of the retainer 450. The outer ledges 466 seat on (or are integrally formed with) an internal ridge 468 of the main housing 404. In the disengaged position, a bottom surface 470 of the peripheral shoulder 438 of the compressor 430 is separated from a top surface 480 of the outer ledges 466 of the base 460 by a space 482.

The retainer 450 may be formed of a resilient material, such as rubber or another elastomeric material. As shown, the retainer 450 includes a contact channel 490 into which a portion of the electrical contact 402 is positioned. The electrical contact 402 includes one or more interstices 494. In the disengaged position, the retainer 450 is not disposed within the interstices 494.

Figure 5:
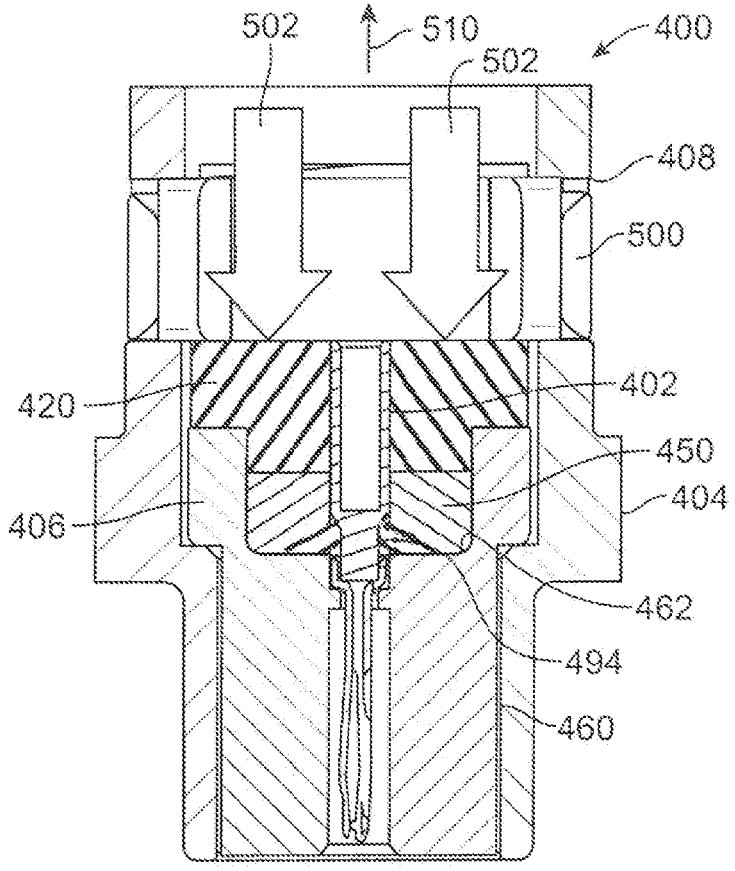
FIG. 5 illustrates an axial cross-sectional view of an electrical connector assembly having a securely retained electrical contact, according to an embodiment of the present disclosure.

FIG. 5 illustrates an axial cross-sectional view of the electrical connector assembly 400 having a securely retained electrical contact 402, according to an embodiment of the present disclosure. In order to securely retain the electrical contact 402 within the contact-retaining chamber 406, an actuator 500, such as any of those described above, is moved into or otherwise within the actuator track 408 so that the actuator 500 exerts an inwardly-directed force 502 into the compressor 420. The force 502 exerted into the compressor 420 is translated into the retainer 450, which is trapped within the pocket 462 of the base 460. Because the base 460 is rigid and fixed in position, the force 502 exerted into the retainer 450 by the compressor 420 causes the resilient retainer 450 to deform. For example, an internal diameter portion of the retainer 450 that defines contact channel 490 flows into or otherwise fills the interstices 494 of the electrical contact 402 (as the retainer 450 is compressively squeezed), thereby providing a positive lock with the electrical contact 402. In this manner, the electrical contact 402 is unable to retreat in the direction of arrow 510, because the electrical contact 402 is securely fixed in place by the deformed portions of the retainer 450 that are disposed within the interstices 494. As such, the electrical contact 402 is securely retained in position without the need for a bulky molded retention feature or the like.

The actuator 500 may be disengaged to release the electrical contact from secure engagement with the retainer. For example, as shown in FIG. 5, the actuator 500 may be released. As such, the compressor 420 retreats in the direction opposite to the arrows 502, and the electrical contact 402 is no longer securely retained by the retainer 450.

Figure 6:
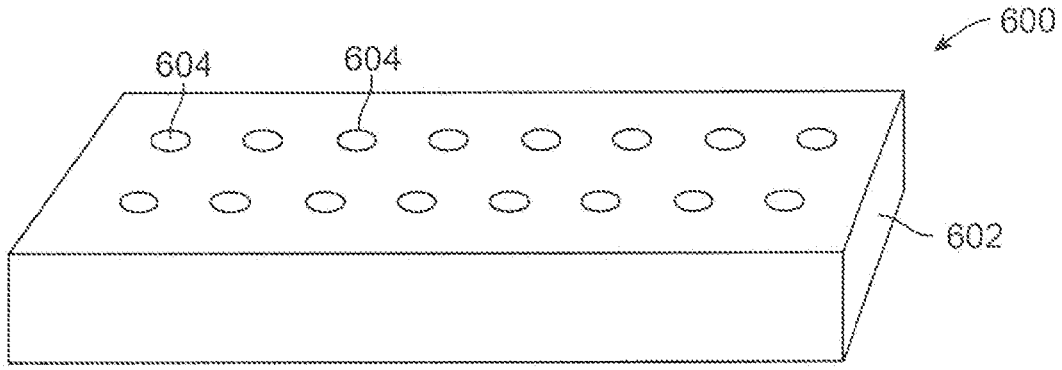
FIG. 6 illustrates a perspective top view of a retainer, according to an embodiment of the present disclosure.

FIG. 6 illustrates a perspective top view of a retainer 600, according to an embodiment of the present disclosure. The retainer 600 may include a main body 602 formed of a resilient material, such as rubber. The main body 602 may be sized and shaped to fit within a pocket of a base. The main body 602 may include a plurality of contact channels 604 that are configured to receive portions of electrical contacts. The number of contact channels 604 may equal the number of electrical contacts within an electrical component, such as an electrical connector assembly. Alternatively, the number of contact channels 604 may be less than a total number of electrical contacts within an electrical component. The retainer 600 may include more or less contact channels 604 than shown.

Figure 7:
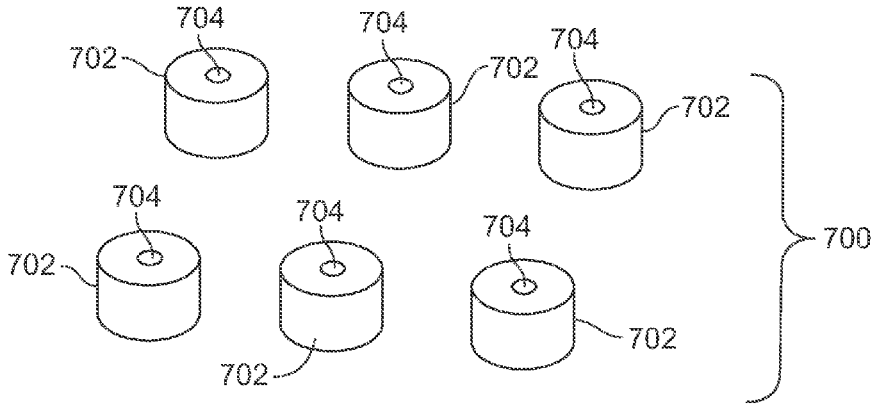
FIG. 7 illustrates a perspective top view of a retainer, according to an embodiment of the present disclosure.

FIG. 7 illustrates a perspective top view of a retainer 700, according to an embodiment of the present disclosure. The retainer 700 may include a plurality of retainer elements 702, each having a contact channel 704. Thus, for each electrical contact within an electrical component, a separate and distinct retainer element 702 may be used. The retainer 700 may include more or less retainer elements 702 than shown.

Figure 8:
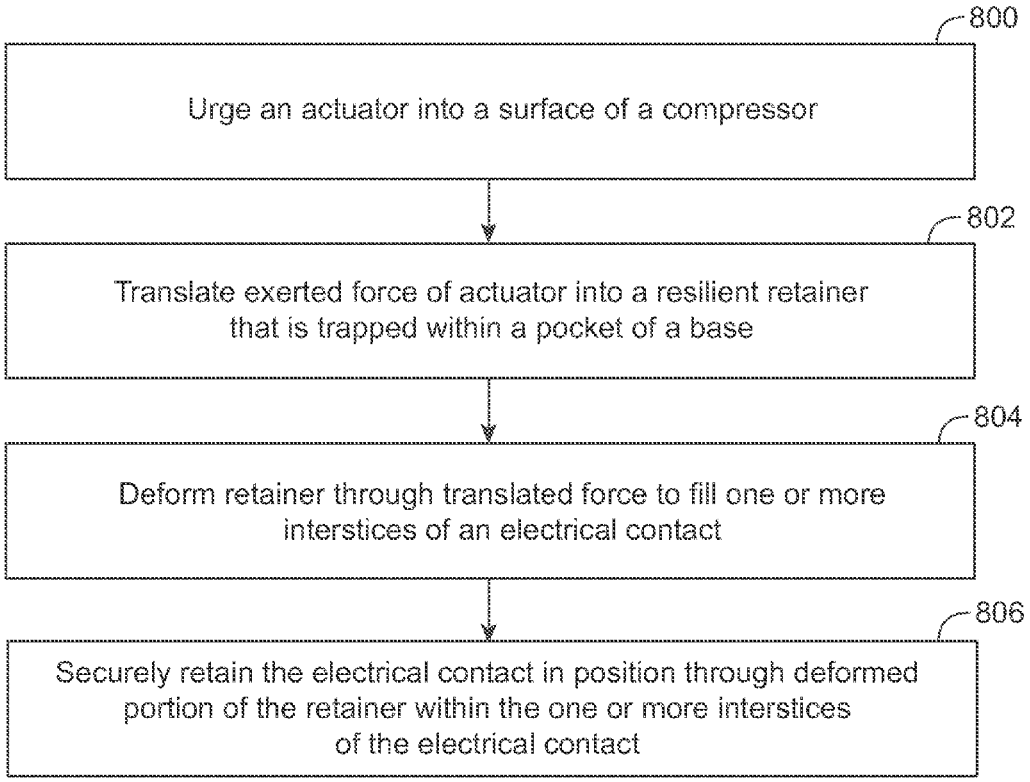
FIG. 8 illustrates a flow chart of a method of retaining electrical contacts within an electrical component, according to an embodiment of the present disclosure.

FIG. 8 illustrates a flow chart of a method of retaining electrical contacts within an electrical component, according to an embodiment of the present disclosure. At 800, an actuator is urged into a surface of a compressor. As the actuator is urged into the compressor, at 802, the exerted force of the actuator is translated into a resilient retainer that is trapped or otherwise sandwiched between the compressor and a base, such as within a pocket of the base. In response to the compressor being forced into the retainer, the retainer deforms at 804 through the translated force and fills one or more interstices of an electrical contact. At 806, the electrical contact is securely retained in position through the deformed portion of the retainer within the one or more interstices of the electrical contact.

Figure 9:
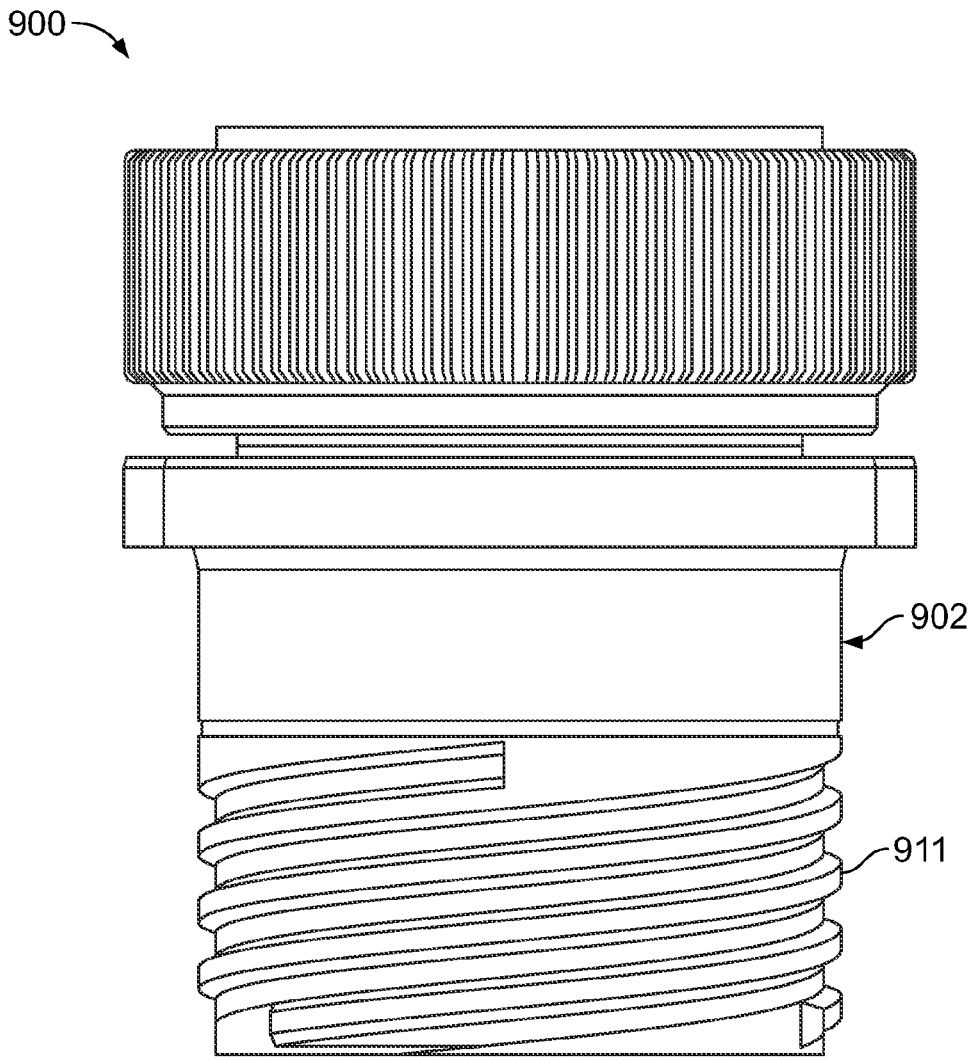
FIG. 9 illustrates a front view of an electrical connector assembly, according to an embodiment of the present disclosure.
Figure 10:
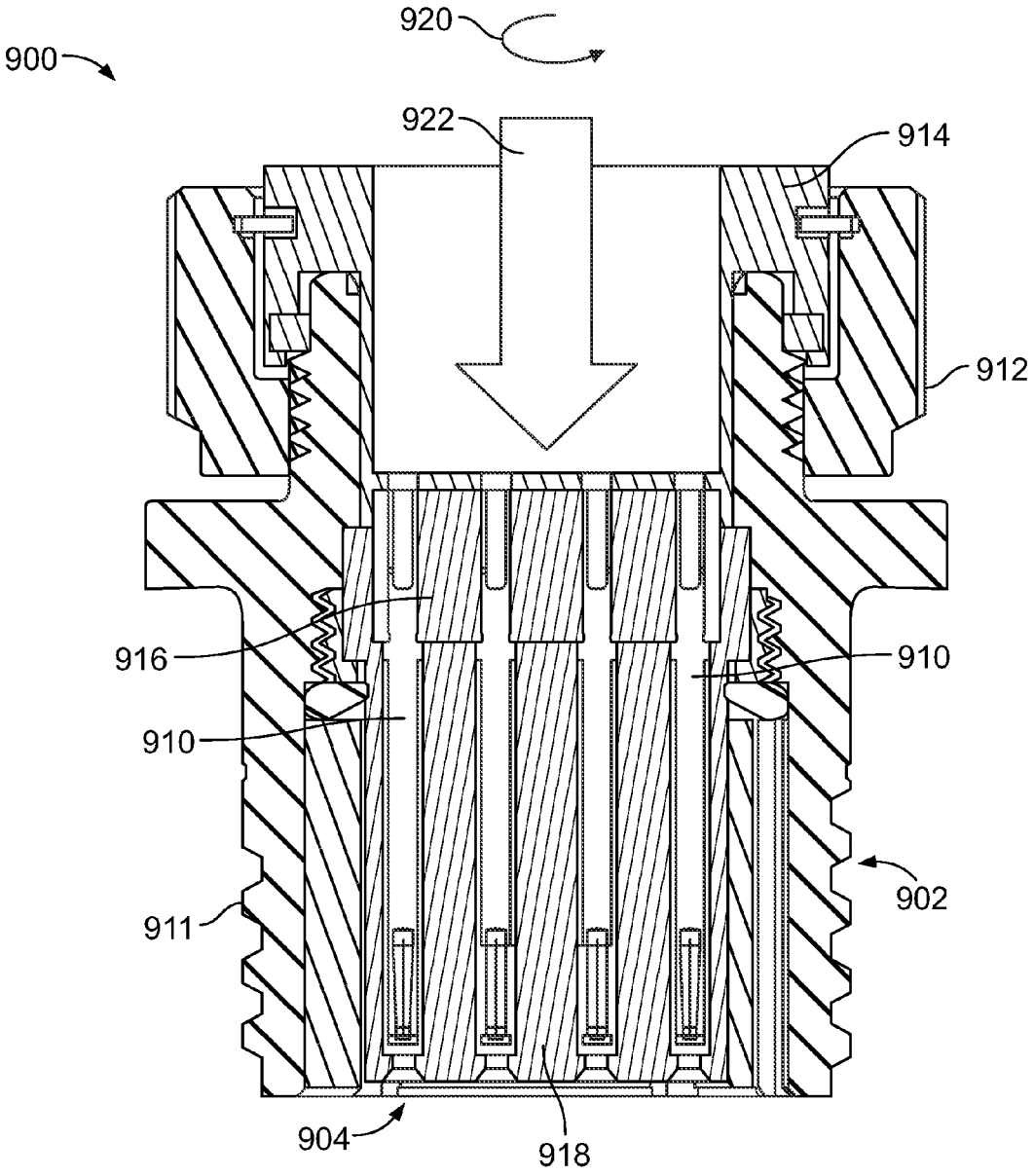
FIG. 10 illustrates an axial cross-sectional view of an electrical connector assembly, according to an embodiment of the present disclosure.

FIG. 9 illustrates a front view of an electrical connector assembly 900, according to an embodiment of the present disclosure. FIG. 10 illustrates an axial cross-sectional view of the electrical connector assembly 900. Referring to FIGS. 9 and 10, the electrical connector assembly 900 includes a main housing or shell 902 that includes a contact-retaining chamber 904 that houses a plurality of electrical contacts 910. As shown, the main housing 902 may include a cylindrical shaft having one or more threaded outer surfaces 911.

An actuator 912, in the form of a threaded cap, may be threadably secured to an upper portion of the main housing 902. The actuator 912 may include, or be connected to, a compressor 914 positioned over a deformable, resilient retainer 916, which, in turn, may be positioned over a fixed, rigid base 918, which may be an integral base portion of the main housing 902. In order to securely.

As the actuator 912 is rotatably engaged in the direction of arc 920, for example, the threadable interface between the actuator 912 and the main housing 902 moves the actuator 912 downward in the direction of arrow 922, which forces the compressor 914 into the retainer 916. As the retainer 916 is compressed between the actuator 912 and/or the compressor 914 and the base 918, the retainer 916 securely retains the contacts 910, as described above. Accordingly, the electrical connector assembly 900 shown in FIGS. 9 and 10 may be rotatably engaged to secure the electrical contacts 910 is a retained position.

As described above, the retainer is configured to be deformed when compressively sandwiched between the compressor and the base, such as when the actuator is urged into the compressor. As the retainer deforms, the deformed portion of the retainer fills or otherwise moves into the one or more interstices formed on or in outer portions of the electrical contact, thereby securely locking the electrical contact in position. The deformed portion of the retainer within the interstice(s) of the electrical contact provides a resistive force that prevents or otherwise resists the electrical contact from dislodging out of an electrical component. Alternatively, the retainer may not be positioned in relation to one or more interstices of an electrical contact. Instead, the force exerted into the retainer by the compressor may simply cause the retainer to compressively constrict around an outer portion of the electrical contact, thereby securely retaining the electrical contact in position.

Thus, embodiments of the present disclosure provide practical systems and methods of efficiently retaining electrical contacts within a high density array or pattern, for example.

While various spatial terms, such as upper, bottom, lower, mid, lateral, horizontal, vertical, and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the disclosure without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. A system for securing one or more electrical contacts within an electrical component, the system comprising:

an actuator configured to be moved into a retaining position in which a retaining force is exerted into a compressor, wherein the retaining force is transmitted to a resilient retainer to securely retain one or more electrical contacts within the electrical component.

2. The system of claim 1, further comprising:

a main housing defining a contact-retaining chamber;

a base fixed within the contact-retaining chamber, wherein the resilient retainer is supported on the base and positioned around at least a portion of the one or more electrical contacts, and wherein the compressor is disposed within the contact-retaining chamber, wherein the resilient retainer is positioned between the base and the compressor.

3. The system of claim 1, wherein the resilient retainer securely retains the one or more electrical contacts by deforming and filling one or more interstices of the one or more electrical contacts in response to the actuator moving into the retaining position.

4. The system of claim 1, wherein the resilient retainer is formed of rubber.

5. The system of claim 1, further comprising an actuator track that moveably retains the actuator.

6. The system of claim 1, wherein the actuator is configured to slide over the compressor into the retaining position.

7. The system of claim 1, wherein the actuator comprises a plunger that is configured to be pushed into the compressor.

8. The system of claim 1, wherein the actuator is configured to be pulled into the compressor.

9. The system of claim 1, wherein the actuator is configured to be rotated into the retaining position.

10. An electrical connector assembly, comprising:

a main housing defining a contact-retaining chamber and including an actuator track;

a rigid base fixed within the contact-retaining chamber;

a resilient retainer formed of rubber and supported on the base and positioned around at least portions of electrical contacts;

a rigid compressor within the contact-retaining chamber, wherein the resilient retainer is positioned between the base and the compressor; and a moveable actuator moveably secured within the actuator track, wherein the moveable actuator is configured to be moved into a retaining position in which a retaining force is exerted into the compressor, wherein the retaining force is transmitted to into the resilient retainer to securely retain the electrical contacts within the electrical component.

11. The electrical connector assembly of claim 10, wherein the resilient retainer securely retains the electrical contacts by deforming and filling one or more interstices of the electrical contacts in response to the moveable actuator moving into the retaining position.

12. The electrical connector assembly of claim 10, wherein the moveable actuator is configured to slide over the compressor into the retaining position.

13. The electrical connector assembly of claim 10, wherein the moveable actuator comprises a plunger that is configured to be pushed into the compressor.

* * * * *